US005397485A

United States Patent [19]

Weichsel et al.

[11] Patent Number: 5,397,485

[45] Date of Patent: Mar. 14, 1995

[54] POWER RESTORING LUBRICANT COMPOSITIONS

[75] Inventors: Richard H. Weichsel, Naples, Fla.; Tirumalai S. Sudarshan, Falls Church, Va.; Thomas D. Nielsen, Elyria, Ohio

[73] Assignee: Applied Metals Technology, Inc., Naples, Fla.

[21] Appl. No.: 835,664

[22] Filed: Feb. 14, 1992

[51] Int. Cl.[6] ..... C10M 125/04

[52] U.S. Cl. ..... 252/25; 252/26

[58] Field of Search ..... 252/25, 26

[56] References Cited

U.S. PATENT DOCUMENTS 3,544,314 12/1970 Bazley ..... 252/26
3,556,779 1/1971 Turkisher et al. ..... 420/491
3,652,414 3/1972 Bergeron ..... 252/26
3,719,477 3/1973 Lundin et al. ..... 420/491
3,894,957 7/1975 Lundin et al. ..... 252/26

*Primary Examiner*—Ellen M. McAvoy
*Attorney, Agent, or Firm*—Fay, Sharpe, Beall, Fagan, Minnich & McKee

[57] ABSTRACT

The present invention relates to lubricant compositions comprising a lubricant base containing alloy particles which comprises a dispersion of very fine lead particles in a copper matrix wherein the particles are substantively uniformly dispersed to provide a very fine microstructure. In general, at least 70% of the lead particles have an average diameter of less than about 100 angstroms with no more than about 30% having an average diameter larger than about 100 angstroms, and the alloy particles have a particle size in the range of from about 3 to about 10 microns.

4 Claims, No Drawings

POWER RESTORING LUBRICANT COMPOSITIONS

BACKGROUND OF THE INVENTION

The present invention relates to novel metal alloy compositions and more particularly to copper-lead alloys and the use of particles of such alloys in lubricant compositions.

Every combustion engine undergoes a continuous process of scratching of the internal surfaces by millions of minute particles that circulate with the engine oil. These particles are hard and arise from asperities that exist on all metal surfaces. No matter how smooth these surfaces feel or appear to the eye, each time a piston moves inside the cylinder, a number of these opposing asperities contact each other. This repeated contact results in the generation of tremendous pressure and heat causing instant microwelding of the asperities to each other. This repeated contact results in the generation of tremendous pressure and heat causing instant microwelding of the asperities to each other. Because the welded asperities are so small, they cannot stop the motion of the moving part, they are sheared, producing tiny particles which are instantly quenched in the motor oil resulting in the formation of hard metal particles. These particles are small and those that are not trapped by the filter can circulate with the motor oil through the engine, repeatedly.

The circulating particles cut scratches in the metal surfaces which results in the production of more asperities. This continuous microwelding and hard particle generation promotes accelerated wear in the engine. The scratches on the cylinder walls and piston rings also serve as miniature escape channels causing compression leaks. During the compression stroke, gas and air mixture blows by through the scratches and when the combustion occurs, explosive power is reduced. Signs of scratches and blowby are manifested as reduced compression and horsepower, increased oil burning usage, and reduced gas mileage.

These engine frictional losses associated with the operation of automotive type equipment account for approximately 5–15% of the energy required to drive such equipment, and are found primarily in the piston ring and skirt area, bearings, valve train, and within the lubricant itself.

Conventionally, special oil additives such as "STP" or the like are often used to reduce friction or lower wear. A significant proportion of these losses can sometimes be restored by modifying the engine oil in service with solid film lubrication. The friction modification capabilities of solid lubricants such as molybdenum disulfide and graphite are well documented. While possessing low coefficients of friction, (0.19 and 0.18 respectively), graphite and molybdenum disulfide still cannot match the coefficient of friction of PTFE, typically 0.04–0.12.

Attempts have been made in the past to employ fine particle size copper-lead alloys as lubricant additives. For example, U.S. Pat. Nos. 3,894,957; 3,719,477; and, 3,556,779 all relate to producing what are alleged to be homogenous copper-lead alloys and/or the use of such alloys in lubricant compositions. U.S. Pat. No. 3,894,957 uses from about 0.25 to about 5% alloy based on the weight of the oil, the alloy containing from about 5 to about 55% lead, preferably 20 to 45% lead, 95 to 45% copper, preferably 80 to 55% copper, with up to 10% by weight of other metals, preferably zinc or tin and trace amounts of a homogeneity promoter. In many cases, such compositions exhibited better properties than previously known compositions, but there was still evidence of significant wear and failure to fully restore lost power and compression because the alloy particles were not truly homogeneous.

One object of the present invention is to produce homogenous fine grained high lead bearing copper alloys having a very fine microstructure.

Yet another object of the present invention is to provide copper-lead alloys containing up to 60% or more by weight lead.

A still further object of the present invention is to provide lubricant composition containing fine particles of such alloys.

SUMMARY OF THE INVENTION

We have now prepared copper-lead alloys containing as much as 60% or more by weight lead having substantially improved very fine microstructure.

We have also found that substantial improvement and compression can be achieved by employing a dispersion of fine particles of such metal alloy in a conventional type motor oil or lubricant, in particular, the use of particles of such copper-lead alloys, having a particle size of from about 3 to about 10 microns. It would appear that while these compositions do not have a coefficient as low as that of PTFE or even necessarily lower than that of graphite or molybdenum disulfide, substantially improved results are achieved. We believe a coating of the alloy is electrochemically deposited on the walls of the engine surface filling the scratches and thereby restoring substantially all of the lost compression.

In the past, there were separate lead and copper phases which were not homogeneously mixed. Therefore, electrodeposition of particles of such alloys along the wall of the liner did not take place, or was not efficient. Copper being higher in the electromotive series than iron deposit on the cylinder liner walls, but the lead particles sunk to the bottom of the oil sump. In the alloy of the present invention, homogeneous dispersion of lead and copper with a fine microstructure results in a codeposit of lead and copper, which fills the scratches and provides substantially improved lubricating action thereby restoring power to the engine.

PREFERRED EMBODIMENT

The novel lubricant compositions of the present invention were prepared by mixing from about 2 to about 50% weight of the copper lead alloy particles having a particle size of less than about 15 microns, with a conventional motor oil or lubricant. Preparation of the alloy particle is discussed below, but is more particularly described in our co-pending application Serial No. (Attorney Docket No. APM 2 002) filed on even date herewith and incorporated herein by reference.

One primary step in preparing the alloys employed in the present invention is the selection of copper, desirably high quality copper (preferably oxygen free high conductivity (OFHC)). The copper is melted in an induction furnace lined with a silicon carbide crucible and the melt is allowed to reach the desired temperature. For example, in a 500 pound heat of a 60-40 Cu-Pb alloy, the amount of copper chosen in 300 pounds and the amount of lead chosen is 200 pounds. Upon melting the copper and slagging the surface of impurities using any of the commercially available slagging agents (such as Slag X), the lead is added in small quantities over a period of time. During this period, the furnace is placed on a hold mode and no temperature input is desired. After the lead charge has been added to the melt, the temperature is brought back up to temperature and held for about a minute. The furnace is now allowed to input further heat until the temperature reaches about 2250° F. During this period, an inert blanket is maintained over the molten metal so as to minimize the evaporation of lead and cause a reduction in the alloy content.

The next step is preferably to add the carefully prepared ingredients to promote homogeneity, preferably folded (bagged) using lead foils. These bags may be attached to a plunger rod for optimum results so that they can reach the lowest portions of the molten metal in the furnace. The use of lead foils in the form of bags is preferred due to the ability of the lead to naturally sink to the bottom thereby ensuring a nice homogenous stirring of the metal during the reaction that ensues between the molten metal and the additives. The additives provide both nucleating sites and a violent stirring action thereby allowing the lead and copper charge to mix homogeneously facilitating an even distribution of copper and lead across the entire melt.

One primary melt additive which is added (about 20–50 grams for every 500 pounds of melt) is silver sulphide. This is usually in the form of fine powder. Other soft metals, such as indium or gold in pure form can also be employed. The affinity between lead and silver is believed to allow a fine coating of the silver to be deposited on the lead particles thereby lowering the surface tension and increasing the solid solubility of lead in copper. Care must be taken to keep the temperature constant at about 2250° F. during the addition of the silver sulphide. It is also advisable to stir the melt after the addition.

The next step is to increase the temperature of the furnace to about 2300° F. and add the rest of the ingredients that have been premixed. A typical mix for 500 pounds of charge of copper-lead at the 60/40 ratio includes a small amount of sodium carbonate, a generally equal amount of copper phosphate, a trace of potassium pyrosulfate and approximately equal amounts of graphite. These chemical components should preferably be blended mechanically together to provide a uniform blend and also be folded into packets using copper (or preferably lead foil) to contain four or five portions of the blend. The packets should be added in quick succession and the melt should generally be stirred, or "rodded", vigorously so that there is a thorough mixing of the additives in the melt.

Usually a violent stirring action ensues and bright yellow, blue, and purple flames may be seen over the melt. This stirring action is due to the reactions in the melt that facilitates the release of a number of gases such as carbon dioxide and the release of the alkali metals such as potassium and sodium. All of these, in addition to stirring the metal, break up the lead into fragments. The furnace temperature is now allowed to cool to about 2000° F. or lower. It is important that, at all stages, a graphite or other inert blanket be maintained on top of the melt so that no oxidation of the lead or copper occurs and the additives involved in the reaction are limited to the melt.

The next step is to pour off the molten metal as quickly as possible into a container for the next process. For instance, if the next step is continuous cast, then it would be to pour the molten metal into silicon carbide holding ladles that are maintained at about 1900° F., if need be, using external gas fired burners. These ladles are located about the continuous casting machine. The continuous caster consists preferably of a hollow die that is attached to a cold starter block. In the initial stages of the casting operation, this cold block allows the metal to solidify. The metal can be drawn at different rates using a motor and a set of pinch rolls. The block is subsequently quenched in an external fluid such as water. The speed of withdrawal of the bar can, of course, be continuously varied and a typical speed that allows the production of a smooth bar is in the range 1–2 inches per minute with a metal consumption of 300 pounds per hour.

The hollow die is preferably a so-called swirl die of the types disclosed and claimed to U.S. Pat. No. 4,315,538 to Thomas D. Nielsen, the drawings and specification of which are specifically incorporated herein by reference. This die consist of a series of equidistantly spaced openings in the side wall that are inclined towards the inner surface of the die and allows the metal to flow in an angular fashion as it leaves the crucible and enters the region of the cold starter block. Due to the inclination of the cavities towards the inner surface, the metal streams strike each other and cause a swirling motion to the fluid as it comes to rest on the cold starter block. This swirling motion of the molten hot metal assists in further fragmenting the droplets and refines the microstructure by generating several sites of nucleation and therefore a fine set of dendrites that interlock with each other. The size of the cavity, its location in the die, and its geometry (dies can be inclined at any slope leading towards the inner surface ranging from 0–90°) are factors that can be adjusted to influence the microstructure of the materials. It is also desirable to control the draw rate of the continuously cast ingot by controlling the exist temperature. Excess exist temperatures may result in coarse grained materials and, in some cases, may give rise to shrinkage cavities or defects (such as holes in the ingot). It is, therefore, very important that the exit temperature be continuously controlled so that consistency is maintained in the microstructure all along the bar. Care must also be taken to ensure that the draw rate is not too slow as this may also result in either a clogging of the die or a coarse microstructure.

The preferred lubricant compositions of the present invention comprise a conventional motor oil containing from about 2 to about 50% by weight of particles of a copper lead alloy containing at least (40%, preferably 25%) lead, said particles of alloy being in the range of from about 2 to about 15 microns.

The alloys are produced as described above by heating copper to about 1275° C. in a crucible in an induction oven to which lead was added (in an amount suitable to produce alloys having a copper lead ratio of 60:40) together with a series of components to improve homogeneity, comprising elemental carbon and a metal compound selected from the group consisting of compounds of an alkaline metal and an alkaline earth metal. For example, sodium carbonate and graphite powder have been found to be particularly useful.

The following examples will serve by way of illustration and not by way of limitation to more particularly describe the preparation of alloys and lubricant compositions within the scope of the present invention and comparative testing of these compositions.

EXAMPLE I

A 500 pound batch of alloy containing approximately 60% by weight of copper and 40% by weight lead was prepared using as a homogeneity enhancer, 2 pounds of sodium carbonate, 2 pounds of cupric phosphate, 30 grams of silver sulfide, 2 pounds of graphite, and 2 pounds of potassium pyrophosphate, all of which were mixed together a reasonably uniformed admixture. The lead was provided in the form of lead foil in strips of approximately 100 foot long by 24 inches wide. The admixture of homogeneity enhancing ingredients was then placed on top of the lead foil strips and the lead folded over to form a series of lead pouches with the homogeneity enhancing admixture contained within the individual pouches. The copper was added to a crucible, melted and brought to a boil at a temperature of about 2250° F. The lead pouches were then added to the molten copper. As the pouches sank to the bottom of the molten copper, the lead melted releasing the homogeneity enhancing ingredients throughout the molten mass and the dissociation of the various homogeneity improving ingredients provided vigorous stirring of the molten metal mixture. The mixing was allowed to continue for a period of approximately 10 minutes, during which the temperature was adjusted to 2200° F. and then transferred to a holding furnace at a temperature of approximately 1200° C. From the holding furnace, the molten metal mass was processed through a swivel die of the type disclosed and claimed in U.S. Pat. No. 4,315,538 and using standard gas atomization powder techniques, particles of alloy having a diameter in the range from about 2 to 50 microns were collected as the final product. Examination of the alloy particles under an electron microscope showed that the copper and lead were uniformly admixed and there was no evidence of a separate lead phase or significant particles of a separate lead phase.

EXAMPLE II

A lubricant composition was prepared by adding 16 grams of the alloy product of EXAMPLE I, to a ½ quart of a standard motor oil product (identity of motor oil) and the motor oil was stirred for 15 minutes to obtain uniform dispersion of the alloy particles within the motor oil composition. The resulting lubricant composition was found to be stable after standing for long periods and there was no substantial evidence of separation of the alloy particles after a period of 52 weeks.

EXAMPLE III

Test Equipment and Instrumentation

The test vehicle had over 100,000 miles showing on the odometer at the start of the test. Compressions were read with a Snap-On Compression Gauge. Each reading was taken on the tenth compression stroke after the candidate vehicle was sitting at ambient temperature overnight.

After the compression readings were documented, the crankcase was drained and charged with the novel lubricant composition of EXAMPLE II. The test unit was then driven 1000 miles on public highways. Most of these miles were accumulated on open highway (greater than 95%). The vehicle returned to the garage and remained at ambient temperature overnight before obtaining "after" compression and leakage readings. The compression and leakage data before and after treatment are set forth in Table 1.

TABLE I

| Cylinder Number | Compression | | Leakage | |
|---|---|---|---|---|
| | Before | After | Before | After |
| 1 | 145 | 150 | 20 | 15 |
| 3 | 130 | 150 | 74 | 9 |
| 5 | 125 | 140 | 14 | 16 |
| 7 | 125 | 150 | 10 | 9 |
| 2 | 130 | 150 | 20 | 16 |
| 4 | 95 | 150 | 82 | 19 |
| 6 | 105 | 155 | 80 | 12 |
| 8 | 125 | 150 | 24 | 14 |

NOTES

*Compression readings were made on a cold engine with the same gauge and are reported in psi.

*Leakage figures are percentages - 100 would be total leakage of pressure charge and 0 would be no leakage. The figures in this chart represent leakage past the rings into the crankcase.

While we are unwilling to be bound by any one theory by which the unexpected results of the present invention might be explained, it is felt that the dispersion of lead and copper is homogeneous, or so close to homogeneous, that the copper and lead are codeposited onto the wear surface, the liner, the piston wall, etc. Also, while the foregoing examples are directed to dispersion of alloy particles in a conventional motor oil, it will be apparent that the lubricating compositions of the present invention have applicability in any internal combustion engine or related type of lubrication application and also that they can be prepared using any suitable conventional motor oil, grease, or other lubricant abase though preferably the lubricant vehicle or base, should have a low viscosity.

It will, of course, be obvious to those skilled in the art that a wide variety of changes can be made in the specific materials, conditions, and ingredients heretofore described. It is our intention to be bound only by the appended claims.

Having thus described the invention, the following is claimed:

1. A lubricant composition comprised of a lubricant vehicle having dispersed therein from about 2 to about 50% by weight of particles of a copper-lead alloy, said particles having an average diameter in the range from about 2 to about 15 microns and being characterized by a substantially uniform dispersion of lead particles in a copper matrix, at least 90% of the lead particles in said alloy having an average diameter in the range of from about 0 to about 200 angstroms, and said alloy being characterized by a substantially uniform microstructure wherein said alloy contains at least about 60% by weight lead.

2. The alloy composition according to claim 1 wherein said particles have an average diameter in the range of from about 3 to about 10 microns.

3. The lubricant composition according to claim 1 wherein said lubricant vehicle is a motor oil.

4. The lubricant composition according to claim 1 wherein said lubricant vehicle is a grease.

* * * * *